US005106483A

United States Patent [19]

Kitano

[11] Patent Number: 5,106,483

[45] Date of Patent: Apr. 21, 1992

[54] METHOD OF JOINING METAL MEMBER TO RESIN MEMBER

[75] Inventor: Minoru Kitano, Nagoya, Japan

[73] Assignee: Far East Tooling Co., Ltd., Aichi, Japan

[21] Appl. No.: 577,022

[22] Filed: Sep. 4, 1990

Related U.S. Application Data

[63] Continuation-in-part of Ser. No. 456,177, Dec. 26, 1989.

[51] Int. Cl.[5] ..... C25D 1/20

[52] U.S. Cl. ..... 205/148; 205/67; 205/183

[58] Field of Search ..... 204/4, 38.7

[56] References Cited

U.S. PATENT DOCUMENTS 4,053,370 10/1977 Yamashita et al. ..... 204/15

FOREIGN PATENT DOCUMENTS 58-48698 3/1983 Japan .

OTHER PUBLICATIONS

IBM Technical Disclosure Bulletin, W. C. Eggert and J. E. Parker, vol. 14, No. 1, Jun. 1971, Metal Coated Plastic Parts.

*Primary Examiner*—T. M. Tufariello
*Attorney, Agent, or Firm*—Oliff & Berridge

[57] ABSTRACT

A method of joining a metal member to a resin member comprising electroforming a roughened surface on a metal member, thereby producing a countless number of minute pores on the surface of the metal member. The cross section of each pore is generally in a shape of a dovetail.

9 Claims, 4 Drawing Sheets

METHOD OF JOINING METAL MEMBER TO RESIN MEMBER

This application is a continuation-in-part of U.S. Ser. No. pb 07/456,177, filed Dec. 26, 1989.

BACKGROUND OF THE INVENTION

1. Field of the Invention

The invention relates to a method of joining a metal member to a resin member.

2. Prior Art

The prior art to which this invention pertains includes a method of forming a rough surface on a metal member by means of etching, honing, applying molten metal, and so forth before resin is laminated thereon. In some cases, adhesive is employed to bond resin layers.

However, it has been pointed out that in the conventional methods, the joining strength between the rough surface and the resin is not sufficient.

A conventional method of joining a resin backing to a metal mold body developed by electroforming is discussed hereinafter to illuminate the problem of the prior art. The following is a manufacturing method of an electroformed mold. Firstly, a thin silver film a few microns thick, which provides conductance, is deposited by silver mirror reaction on the surface of an electroform matrix. The electroform matrix is then immersed in nickel plating solution. Secondly, the electroform matrix is connected with the anode of an electrical source while the nickel material for plating is connected to the cathode of the electrical source. The predetermined level of electricity is loaded between the electrodes to deposit a metal layer on the electroform matrix, thereby forming a metal mold body. Further, backing resin is injected into or laminated on the metal mold body to obtain an electroformed mold reinforced by laminated resin on the back thereof.

This method, however, has a problem that the backing material for reinforcement easily separates from the metal mold body due to deformation caused by external heat or force. As the resin backing tends to separate from the metal mold body, the resin is unreliable as a reinforcement backing material. Hence, the metal mold body must be made thick.

SUMMARY OF THE INVENTION

The principal object of the invention is to provide a solution to the problem of the prior art described above.

Another object of the present invention is to provide a broadly applicable joining technique which can be employed to join a metal member to a resin member.

A further object of the present invention is to provide a method for electroforming a roughened surface on a metal surface such that countless number of minute pores wherein the cross section of each minute pore is generally in the shape of a dovetail.

A further object of the present invention is to provide a method of increasing bond strength between a metal member and a resin member.

To achieve those objects, the present invention employs a method of joining a metal member to a resin member. The first step of the method is electroforming a roughened surface on the metal member such that a countless number of minute pores on the surface develop. The cross-section of each minute pore is generally in the shape of a dovetail in which the distance between two points on the inner surface, both points being in a plane substantially parallel to the surface of the metal member, generally increases as the points of measurement approach the bottom surface of said pore. The second step comprises laminating, injecting, or applying resin to said roughened surface in order that said metal member is joined to said resin. Nickel, copper, or any other metal commonly employed for electroforming will suffice for the present invention.

The following are two methods of electroforming a roughened surface such as is described above.

1. A hydrophobic insulating substance is sprayed onto a surface of a metal member or a silver mirror surface of an electroformed mold making a countless number of insulated points on the conductive part. During electroforming, the surface roughens as the insulated points become the bottoms of countless pores because electrodeposition does not occur at the insulated points.

2. Another method of electroforming a roughened surface comprises the steps of employing sulfamic acid containing impurities as a plating solution, applying a slightly stronger electric current for electroforming, and adjusting the pH level or temperature of the solution.

There are other known methods of electroforming a roughened surface on a metal member. According to one method, a metal sheet manufactured by, for instance, rolling is electroformed. Another method comprises electroforming a metal member of predetermined thickness and further electroforming a roughened surface.

On the other hand, forming resin layers on a roughened surface can also be performed in various methods: applying adhesive and laying resin by hand; placing a mold on the roughened surface and injecting resin therein by vacuum forming.

The manner of operations of joining a metal member to a resin member of this invention is as follows: first, a metal member having a roughened surface with minute pores whose cross-sections are generally in the shape of an dove-tail is electroformed; a resin member is laminated, injected, or spread on the roughened, sponge-like surface.

This joining method allows the roughened surface with minute pores whose cross-section is generally in the shape of a dove-tail formed on the metal surface to interlock firmly with the resin member formed thereon, thereby increasing bond strength between the metal member and the resin member.

DETAILED DESCRIPTION OF THE PREFERRED EMBODIMENTS

The present invention embodied in a method of molding metal to resin layers is described in connection with the drawings hereinafter.

Figure 1:
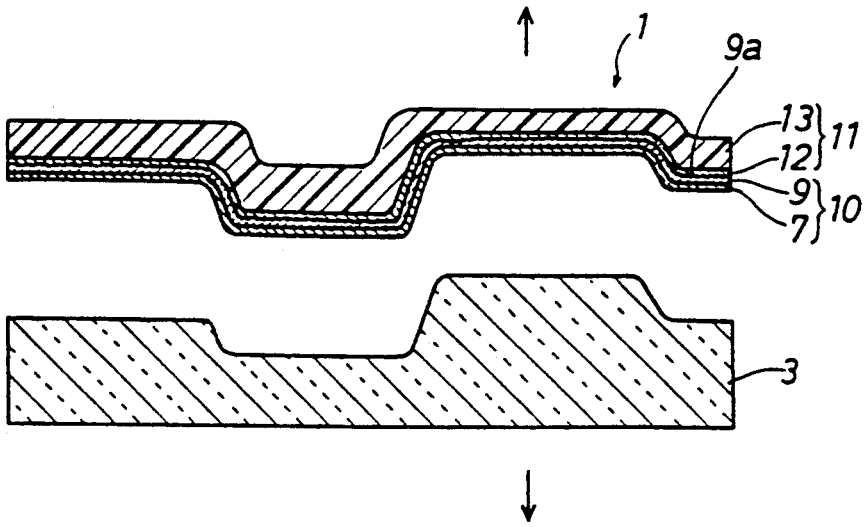
FIG. 1 is a sectional view of a metal body and an electroforming matrix in accordance with the preferred embodiment of the present invention.

FIG. 1 is a sectional view of the metal body with an electroforming matrix detached therefrom.

Figure 2A:
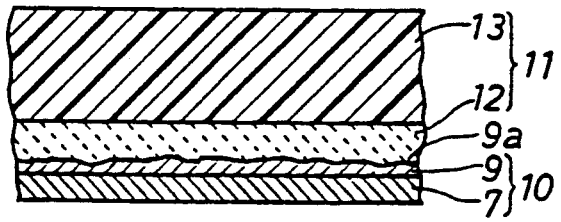
FIGS. 2(A) and (B) are enlarged partial sectional views of the metal mold.

FIGS. 2(A) and (B) are enlarged partial sectional view of the metal mold.

Indicated at 1 is a metal mold developed by electroforming while indicated at 3 is the electroform matrix.

Figure 2B:
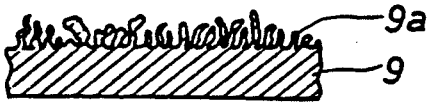
Figure 3:
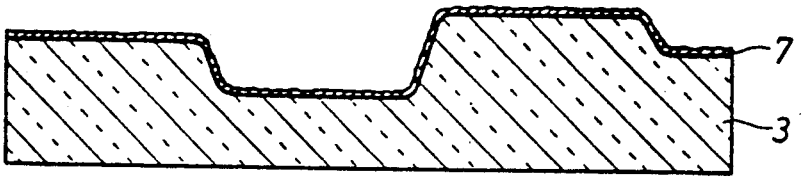
FIGS. 3 to 6 inclusive are illustrations of the manufacturing process of the metal mold.

As illustrated in FIG. 2, a metal body 10 comprises a first metal layer 7 and a second metal layer 9 having a roughened surface 9*a*, with minute pores whose cross section is generally in the shape of a dovetail, is formed thereon. FIG. 2(B) is an enlarged partial view of the roughened, sponge-like surface 9*a*. Further, a reinforcement member 11 for reinforcing the metal body 10 comprises laminations of a resin layer 12 and a glass fiber layer 13.

A method of manufacturing the metal mold 1 will be described below based on FIGS. 3 to 6 inclusive. First, the electroform matrix 3 is formed. A material for this electroform matrix 3 may be selected from commonly used materials including epoxy, acrylic, acrylic-butadiene, styrene copolymer, and other synthetic resins, solid wax, metals, wood, ceramics, cloth, thread, and so forth. In this embodiment, epoxy resin is employed.

In this step, a few microns thick metal film for conductivity is formed on the surface of the electroform matrix 3 by silver mirror reaction.

Second, nickel electroforming is performed as follows: the electroform matrix 3 having a metal film is immersed in a plating solution of Ni(Nickel)-sulfamate with or without a surface active agent mixed therein; the electroform matrix 3 is connected with a cathode while the nickel material is connected with an anode; electroforming is performed to deposit nickel on the metal film; thus, the first metal layer 7 is formed. In this step, the level of electricity used for electroforming is set at about 0.2 to 2 amps per 1 square decimeter so that the first metal layer 7 is made 1 to 1.5 mm thick.

Figure 4:
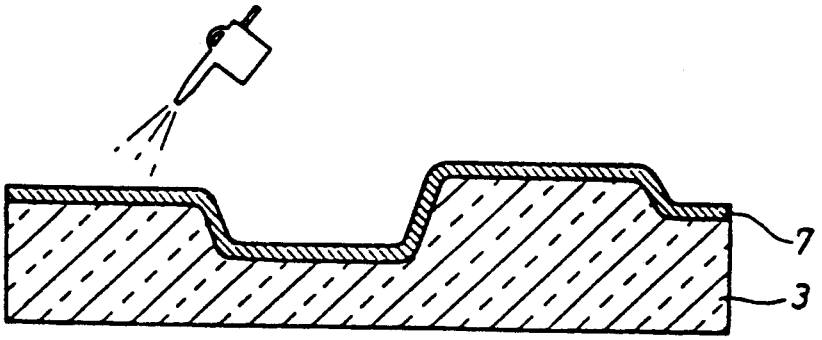

Third, the electroform matrix 3 is taken out of the solution and a volatile solution in which a hydrophobic insulation substance is dissolved is sprayed onto the first metal layer 7 as shown in FIG. 4. Then, a hydrophobic insulation substance is applied thereto, which causes an oxidized film to develop on the surface of the first metal layer 7. An etching treatment is performed using hydrochloric acid or other suitable substances to remove the oxidized film.

Figure 5:
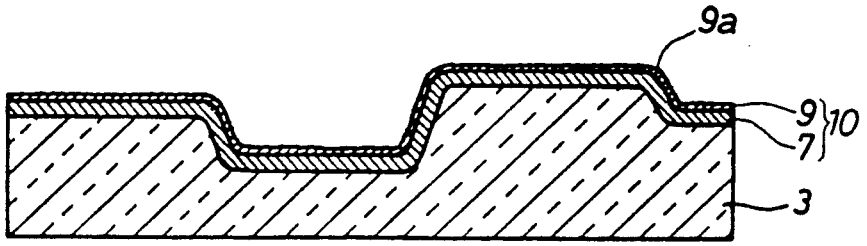

Fourth, electroforming is performed again in a vessel containing plating solution similar to the solution described above. In this step, a sulfamic nickel solution containing no surface active agent is used and 0.5 to 4 amps per 1 square decimeter is carried for a period of one to two days to obtain a second metal layer 9 which is 0.5 to 3 mm in thickness (FIG. 5). After this electroforming treatment, the roughened surface 9*a* with pores whose cross section is generally in the shape of a dovetail has been formed on the metal layer 9 as illustrated in FIG. 2(B). In this embodiment, the roughened, sponge-like surface 9*a* is easily formed because a surface active agent is not mixed in the plating solution. Furthermore, as described above, hydrophobic insulation particles are applied to the first metal layer 7, which causes a roughened surface with minute pores whose cross sections are generally in the shape of a dovetail to develop whereas in conventional electroforming, simple stick-like projections are developed.

Figure 6:
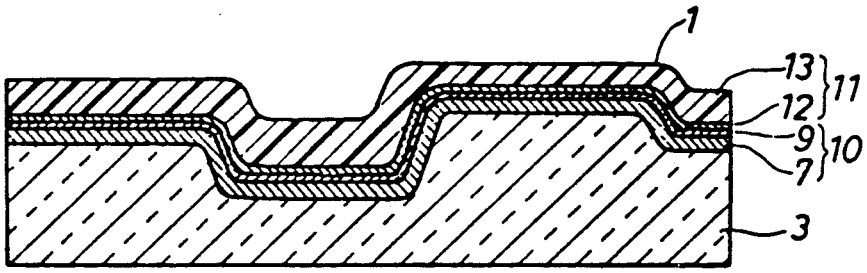

Fifth, the reinforcement member 11 is formed as a backing as illustrated in FIG. 6. Firstly, epoxy resin is applied by a brush etc., on the roughened surface 9*a*, forming a resin layer 12. The resin layer 12 smoothes the roughened layer 9*a*. Secondly, a fiber glass layer 13 is laminated thereon. The fiber glass layer 13 comprises four to five sheets of glass cloth containing epoxy resin. The reinforcement member 11 is now formed.

Finally, a heat treatment is performed at about 40 degrees for around 7 to 8 hours in an electric furnace to increase mechanical strength such as tensile strength of the reinforcement member 11. Then, the electroform matrix 3 is removed from the metal mold 1 to complete the manufacturing process of the metal mold 1 (FIG. 1).

Accordingly, in the above-described embodiment, the roughened surface 9*a*, with minute pores whose cross sections are generally in the shape of a dovetail, formed on the second metal layer 9 interlocks firmly with the resin layer 12, thereby increasing the bond strength between the metal body 10 and the reinforcement member 11 made of backing resin.

Moreover, the metal mold body 10 is so securely and firmly joined to the reinforcement member 11 that the metal mold 10 is made structurally strong. So the metal mold body 10 can be made thin and, therefore, manufactured in a shorter period of time.

While the metal mold 1 of this embodiment is manufactured in the steps described above, for alternative embodiments, the following variation of steps may be added to or replace some steps included in the first embodiment.

1. The first metal layer 7 can be manufactured by other methods than electroforming described above.

2. The metal which comprises the metal layers 7 and 9 may be selected from any metals commonly employed for electroforming other than nickel.

3. After the formation of the first metal layer 7 made of nickel, the first metal layer 7 is plated with copper, which is easily activated, to prevent oxidation. Then, hydrophobic insulation substance is applied and the second metal layer 9 is formed. In this way, etching treatment can be simplified.

4. Insulation particles may be applied to limited parts of the metal mold 1 to concentrate the formation of a crater-like or honeycomb-like surface in certain areas so that the bond strength between the metal mold body 10 and the reinforcement member 11 is locally increased in those areas.

Figure 7:
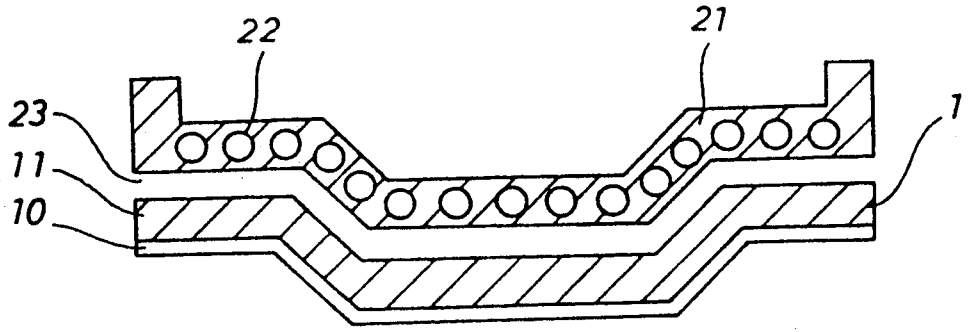
FIGS. 7 and 8 inclusive are cross-sectional side views of an application of the invention.
Figure 8:
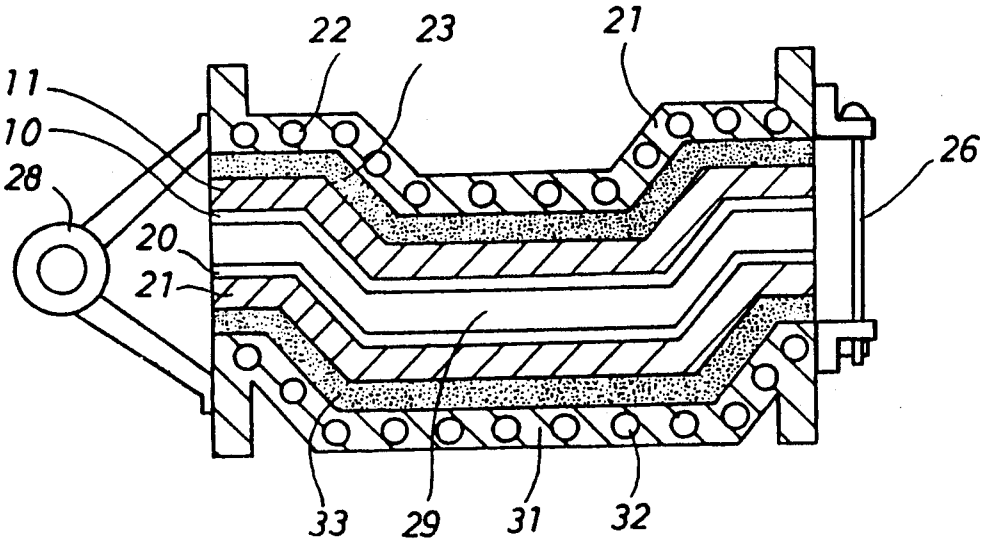

5. In an alternative embodiment, as shown in FIG. 7, an upper aluminum frame 21 may be held above the metal mold body 10 having a resin member 11 thereon so that a predetermined space 23 exists between the upper frame 21 and the resin member 11. A plurality of pipes 22 through which liquid is passed are provided in the upper frame 21 for controlling the temperature of adhesive epoxy resin injected into the space 23. Then as shown in FIG. 8, another metal mold body 21 having a resin member 20 is held above a lower aluminum frame 31 so that there is a space 33 between the lower frame 31 and the resin member 20. Like the upper frame 21, the lower frame 31 has a plurality of pipes passed therethrough to control the temperature of adhesive epoxy resin injected into the space 33. A hinge 28 and a clamp 26 are mounted on either end of the upper and the lower frames 21, 31. The clamp 26 has a bolt and a nut for opening and closing the aluminum frames 21, 31. The bolt and the nut may be replaced with an opening and closing means operated by oil-pressure to open and close the clamp. A cavity 29 is created between the metal mold body 10 and the metal mold body 20. Foaming plastic resin is injected into the cavity 29.

6. Although in the first embodiment, adhesive is used to increase the bond strength between the roughened, sponge-like surface 9a and the reinforcement member 11, adhesive may be dispensed with in this step, depending on the use.

7. A metal layer having the roughened, sponge-like surface 9a may be electroformed directly on the metal film formed by silver mirror reaction on the electroform matrix 3. In the first embodiment, after the first metal layer 7 is formed, the second metal layer 9 having the roughened surface 9a is electroformed.

We will now more fully describe the necessary conditions for producing pores with cross sections which are generally in the shape of a dovetail. In electroforming, if hydrophobic insulation material is spread on a plating surface, electrodeposition occurs around the spots of the hydrophobic insulation material to form a plated surface. In ordinary electroforming, however, the resultant pores are in the shape of the inner surface of an ordinary glass with the diameter becoming larger as it gets closer to the plated surface, making the openings thereof larger than the spots on the bottom. Therefore, the conditions disclosed herewith allow the diameter to become progressively smaller toward the openings, thus obtaining dovetail-shaped pores.

Plating carried out above a limiting current density creates hydrogen, which hampers crystal growth and creates a porous, sponge-like plated surface. While sulfamic acid solution facilitates pit formation, it effectively causes uniform electrodeposition and has a high limiting current density. Therefore, to use nickel sulfamate solution which contains little surface active agent is not sufficient for forming dovetail-shaped pores. If other necessary conditions are not fulfilled, and especially if the plated surface is to be thick, pores tend not to form on the plated surface; thus, it is essential to control the current density toward a limiting current in order to obtain a porous surface. Further, it is recommended to use a clean solution, to avoid addition of a surface active agent, and to add some organic substance ($NH_4^+$, $SO_3^-$, $HSO_4^-$, *etc.) so as to obtain dovetail-shaped pores on a plated surface.*

In conclusion, the important conditions for facilitating the formation of the pores are, provided that minute spots of hydrophobic insulation material are spread on the plating surface:

a) the composition of the plating solution,
b) the temperature of the plating solution,
c) the limiting current density,
d) the pH value of the plating solution, and
e) the plating solution containing little or no surface agent.

It is not necessary to meet all of conditions a)–e) to form dovetail-shaped pores. The diameter of the openings of the dovetail-shaped pores, which determines the angle of the inner wall of the pores to the plated surface, can be controlled by selectively combining the above conditions.

It is known that if used at a pH value of 3.0 or lower for a long period of time, nickel sulfamate hydrolyzes itself to become nickel ammonium sulfate. This will slightly change the optimum conditions for use. Also, nickel sulfamate containing chlorine ions hardly hydrolyzes at a temperature between 50° C. and 60° C. at approximately 3.5 pH. Sulfamic acid does not easily hydrolyze and provides performance of a long duration. The following is the reaction formula of the above-explained hydrolysis:

$$NH_3^+SO_3^- + H_2O \rightarrow NH_4^+ + HSO_4^-$$

Sulfamic acid ion, $NH_2SO_3$, hydrolyzes to become ammonium ion and sulfate ion as shown in the following reaction formula:

$$NH_2SO_3^- + H_2O \rightarrow NH_4^+ + SO_2^{-2}$$

High temperature and/or low pH tend to accelerate hydrolysis. Although heavy metals such as nickel accelerate hydrolysis, higher concentrations of nickel sulfamate decelerates hydrolysis. Hydrolysis eventually gives an adverse affect of increasing of internal stress.

Table 1 shows how pH, temperature, and concentration affect hydrolysis of sulfamic acid solution.

TABLE 1

| CONCENTRATION OF NICKEL SULFAMATE (g/l) | TEMPERATURE CENTIGRADE | PH VALUE | $NH_4$ CONCENTRATION (g/l) 336 HOURS LATER |
|---|---|---|---|
| 300 | 70 | 2.0 | 9.7 |
| | | 4.0 | 0.95 |
| 450 | 70 | 4.0 | 0.33 |
| 600 | 65 | 4.0 | 0.035 |
| | 70 | 4.0 | 0.18 |

The amount of hydrolysis substance obtained from the solution containing 300 g/l nickel sulfamate after keeping the solution for up to 75 days at 50° C. at a pH value ranging from 3.5 to 4.0.

TABLE 2

| DURATION (DAYS) | $SO_4$ CONCENTRATION (g/l) | $NH_4$ CONCENTRATION (g/l) |
|---|---|---|
| 0 | 0.25–0.55 | 0.25–0.55 |
| 18 | 1.07 | |
| 27 | 1.97 | 1.00 |
| 50 | 2.26 | |
| 75 | 3.60 | 1.21 |

Both $SO_4$ and $NH_4$ are free acids produced by a chemical reaction which occurs during solution making. The reaction formula is as follows:

$$NiCO_3 + 2NH_2SO_3H = Ni(Nh_2SO_3)_2 + H_2O + CO_2$$

Hydrolysis of sulfamic acid produces the same amount of SO4 and NH4. Comparison of the data obtained on the 27th day and the 75th shows that roughly 50% of the $NH_4$ disappeared (1.21/1.00=1.21), while a much smaller percentage of $SO_4$ disappeared (3.6/1.97=1.83). If the same amount of the two substances are produced, the concentration of $NH_4$ should be much higher. Therefore, it is presumed that approximately 50% of $NH_4$ has been decomposed into $NH_3$ and $H_2$. It is further noted that electrolyzation of nickel sulfamate solution containing chloride compositions by inert anode produces sulfate and nitrogen gas but not chloride gas.

The conditions of hydrolysis of plating solution obtained by experiments generally agree with the data obtained from the technical literature. Therefore, if the important conditions set forth above (i.e., a)–e)) are met, a porous, sponge-like metal surface can be obtained.

The composition of an exemplary plating solution is set forth below.

| | |
|---|---|
| Sulfamic acid Ni | 250–450 g/l |
| Chloride Ni | 3–20 g/l |
| Boric Acid | 10–50 g/l |
| Special Organic Substance | 1–35 g/l |
| pH Value | 2.2–4.2 |
| Temperature | 35–60° C. |
| Current Density | 0.1–4 A/dm$^2$ |

Although the concentrations of nickel sulfamate, nickel chloride, and boric acid are about the same as those in a normal bath, which contains a surface active agent, addition of the special organic substance reduces the limiting current density, thus facilitating the formation of porous electroformed metal. The addition of the special organic substance also determines the shape of the pores.

Because the concentration of the special organic substance, such as $NH_4^+$, $SO_3^-$, $HSO_4^-$, is variable due to electrolysis, it should always be controlled based on the result of quantitative analysis. The pH value is set to be somewhat lower than the ordinary value in order to accelerate generation of hydrogen. Hydrogen gas adhering to the plating surface causes electroformed metal with a porous, sponge-like surface. Surface active agent weakens surface tension, hindering formation of hydrogen gas foam on the plating surface and also tends to close the openings of the pores. Therefore, either a surface active agent is not added or a very little amount of it is added.

While the preferred embodiment described above is an application to a joining method using an electroformed mold, it is to be understood that modifications and variations may be made without departing from the spirit or scope of the invention as far as the method is employed to join a metal member and a resin member.

In accordance with the present invention, the roughened surface with pores whose cross sections are generally in the shape of a dovetail is formed on the second metal layer interlocks firmly and securely with the resin layer, thereby increasing the joining strength between the metal member and the resin member.

What is claimed is:

1. A method of joining a metal member to a resin member comprising the steps of:

electroforming a roughened surface on a surface of the metal member such that countless number of minute pores develop on the surface thereof, wherein the cross section of each pore is generally in a shape of a dovetail in which the distance between two points on the inner circuit, whose points are in a plane substantially parallel to the surface of the metal member, generally increases as the points of measurements approach the bottom surface of said pores; and laminating, injecting, or applying resin to said roughened surface in order to join, said metal member to said resin.

2. The method of claim 1 wherein the step of electroforming a roughened surface on the metal member comprises the steps of:

spreading adhesive on the surface of the metal member;

applying a hydrophobic insulation substance to the adhesive on the surface of the metal member;

introducing acid onto the surface of the metal member to create an etched surface of the metal member; and electroforming the etched surface to form a roughened sponge-like surface on the metal member.

3. The method of claim 2, wherein metal particles are applied to the adhesive on the surface of the metal member instead of the hydrophobic insulation substance.

4. The method of claim 3, wherein the metal particles are chosen from the group of metal particles consisting of aluminum or iron powder.

5. The method of claim 2 wherein the step of electroforming comprises the steps of:

immersing the etched surface in sulfamic acid solution that does not contain a surface active agent;

attaching a cathode to the etched surface;

inserting an anode in the plating solution; and applying a voltage across the cathode and anode.

6. The method of claim 3 wherein the step of electroforming comprises the steps of immersing the etched surface in sulfamic acid solution that does not contain a surface active agent;

attaching a cathode to the etched surface;

inserting an anode in the plating solution; and applying a voltage across the cathode and anode.

7. The method of claim 2, wherein the hydrophobic insulation particles are concentrated in predetermined areas of the metal member to increase a bond strength between the metal member and the resin member in the predetermined areas.

8. The method of claim 1, wherein the roughened surface is formed such that it has projections for engaging the resin member, where the projections engage the resin member so that the resin member does not separate from the metal member when separating forces orthogonal to the roughened surface are applied to the metal member or the resin member.

9. The method of claim 1, wherein the step of forming the resin member on the roughened surface comprises the steps of:

applying liquid resin to the roughened surface of the metal member; and allowing the liquid resin to set to form the resin member.

* * * * *